United States Patent [19]

Jones et al.

[11] 3,955,077

[45] May 4, 1976

[54] LAMP REFLECTORS AND MOTOR VEHICLE LAMP ASSEMBLIES INCORPORATING SAME

[75] Inventors: Kenneth James Jones, Sutton Coldfield; Robert Arthur Hargroves, Solihull, both of England

[73] Assignee: The Lucas Electrical Company Limited, Birmingham, England

[22] Filed: Sept. 27, 1974

[21] Appl. No.: 509,963

[30] Foreign Application Priority Data

Sept. 29, 1973 United Kingdom ..... 45656/73

[52] U.S. Cl. ..... 240/41.3; 240/7.1 R; 240/41.1

[51] Int. Cl.[2] ..... F21V 13/04

[58] Field of Search ..... 240/41.3, 41.35, 41 R, 240/7.1 R, 103 R, 41.1, 41.37

[56] References Cited

UNITED STATES PATENTS

| | | | |
|---|---|---|---|
| 1,898,167 | 2/1933 | Bean | 240/41.37 |
| 2,106,995 | 2/1938 | Clary | 240/41.1 |
| 3,492,474 | 1/1970 | Yamaguchi et al. | 240/41.37 X |
| 3,900,726 | 8/1975 | Tichenor | 240/41.35 R |
| 3,904,864 | 9/1975 | Jones et al. | 240/41.35 R |

FOREIGN PATENTS OR APPLICATIONS

| | | |
|---|---|---|
| 890,072 | 2/1962 | United Kingdom |

*Primary Examiner*—R. L. Moses
*Attorney, Agent, or Firm*—Holman & Stern

[57] ABSTRACT

A lamp reflector comprising a dished body having a reflective inner surface, the body being elliptical in vertical axial section and having a different shape in horizontal axial section, which may be elliptical, arcuate or parabolic. The horizontal width of the body taken in a transverse vertical cross-section is greater than its vertical height.

A vehicle lamp assembly comprising a reflector as defined above, a lens receiving light from the reflector, and a mask mounted between the two. The reflector and the mask or the mask alone may be movable relative to the lens.

14 Claims, 5 Drawing Figures

LAMP REFLECTORS AND MOTOR VEHICLE LAMP ASSEMBLIES INCORPORATING SAME

This invention relates to lamp reflectors and to motor vehicle lamp assemblies, particularly, but not exclusively, headlamp assemblies, incorporating such lamp reflectors.

According to the present invention, there is provided a lamp reflector comprising a dished body having a reflective inner surface, said body being elliptical in vertical axial section and having a different shape in horizontal axial section, said body also having a transverse vertical cross-section in which its horizontal width is greater than its vertical height.

The horizontal axial section of the body may be elliptical, arcuate or parabolic.

The vertical axial section preferably has an eccentricity $e$ of between 0.40 and 0.75, inclusively. An eccentricity $e$ of 0.60 is most preferred.

The above defined reflector is mainly intended for use in a motor vehicle lamp assembly in which a lens (as defined herein) is arranged to receive light from the filament mounted in the reflector. The reflector may be displaced relative to said lens to enable dipping of the beam projected by the lamp assembly in use.

By the expression 'a lens' is meant single lens, a lens assembly or a curved reflector which has a focal plane.

Conveniently, the lens has a focal plane which lies at an outer focal plane of elliptical vertical section of the reflector body.

When a sharp cut-off beam is required, a mask is mounted between the reflector and the lens at the focal plane of the latter, said mask being disposed to provide a sharp cut-off for the top of the beam projected by the lamp assembly in use.

Figure 1:
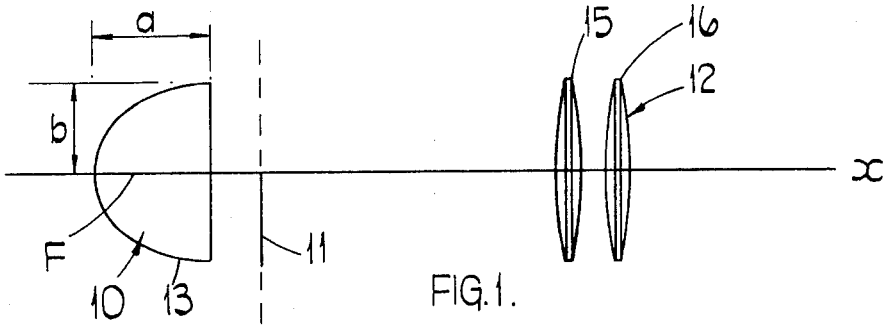
Figure 2:
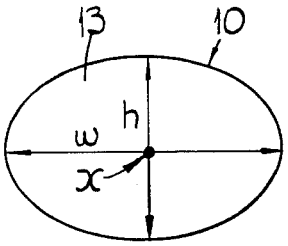
Figure 3:
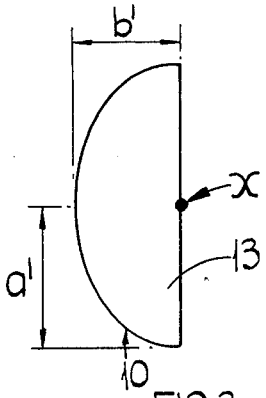
Figure 4:
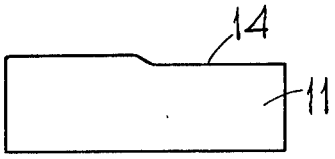
Figure 5:
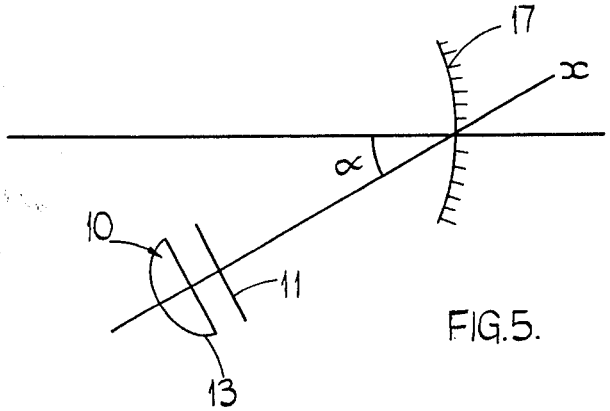

Embodiments for the present invention will now be described, by way of example, with reference to the accompanying drawing, in which:

FIG. 1 is a schematic view in axial section of a lamp reflector according to the present invention incorporated in a lamp assembly, FIG. 2 is a front view of the lamp reflector shown in FIG. 1, FIG. 3 is a horizontal axial section of the reflector of FIGS. 1 and 2, FIG. 4 is a front view of a mask forming part of the lamp assembly of FIG. 1, and FIG. 5 is a schematic plan view of the lamp reflector and mask of FIGS. 1 to 4 incorporated in a modified lamp assembly.

Referring now to the embodiment of FIGS. 1 to 4, the lamp assembly illustrated therein is intended for use as a headlamp assembly in a motor vehicle. The lamp assembly comprises a reflector 10, a mask 11 and a lens assembly 12. The reflector 10 comprises a dished body 13 which has a reflective inner surface. The body 13 is elliptical in vertical axial section (see FIG. 1) and, in this embodiment, has an eccentricity $e$ of 0.60. The ellipse is defined by the formula $$\frac{x^2}{a^2} + \frac{y^2}{b^2} = 1,$$

where $a = 34$ mm and $b = 27$ mm. The body 13, furthermore, has a horizontal axial section of a different shape, the shape being in the form of an ellipse having an eccentricity $e$ of 0.84. This ellipse is defined by the formula $$\frac{x^2}{a'^2} + \frac{y^2}{b'^2} = 1,$$

where $a' = 42$ mm and $b' = 23$ mm. The body 13, furthermore, has a vertical cross-section in which its horizontal width $w$ is greater than its vertical height $h$ (see FIG. 2). The vertical and horizontal axial sections described above are blended using elliptical section parallel to the plane of the ellipse shown in FIG. 2.

This shape of lamp reflector produces a beam which is horizontally spread further than a beam produced from an ellipsoidal reflector having a circular opening. This is a particular advantage where vehicle headlamps are concerned since it is desirable to provide a larger horizontal than vertical spread of illumination.

The mask 11 is of planar form and is disposed in the outer focal plane of the ellipse in the transverse vertical axial section of the body 13. The mask has a stepped upper edge 14 arranged so that the upper step is disposed just about axis $x$ of the reflector body whilst the lower step is disposed just below the axis $x$ in order to produce the desired beam shape.

The lens assembly 12 consists of two lenses 15 and 16 and has a focal plane which lies in the outer focal plane in which the mask 11 is disposed. The positioning of the mask 11 in the above-described manner relative to the lens assembly 12 and reflector body 13 enables a sharp image of the upper surface 14 to be projected by the lamp assembly. Inversion of the light beam emanating from the reflector 10 occurs in the lamp assembly so that the mask 11 provides a sharp cut-off of the top of the beam projected from the lamp assembly.

A lamp filament F is mounted in the body 13 to lie partially on the inner focal point of the elliptical vertical axial section.

Referring now to FIG. 5, the lamp assembly illustrated therein employs the reflector body 10 and mask 11 as described in the embodiment of FIGS. 1 to 4. The lamp assembly further includes a parabolic reflector 17 which replaces the lens assembly 12. It will be seen from FIG. 5 that axis $x$ of the reflector body 13 includes an angle $\alpha$ with the axis of the parabolic reflector 17. In this embodiment, angle $\alpha$ is 25°. The angle $\alpha$ is provided to ensure that the beam projected by parabolic reflector 17 is not obscured by the body 13 or mask 11.

In a modification (not shown), the reflector 10 and mask 11 is mounted in the lamp assembly so as to be capable of moving in a vertical plane. This movement enables the beam projected by the lamp assembly to be raised and lowered.

In a further modification, the mask 11 only is mounted for movement to modify the cut-off line.

It will be manifest that a lamp reflector of the type described above is of rather complex shape, and for this reason, it is possible for slight inaccuracies in the reflective surface to produce 'holes' in the projected beam. The Applicants have found that such 'holes' can be masked by roughening the surface of the reflector in the region thereof which is causing the 'hole', e.g. by lightly sand blasting.

The lamp reflector described above is particularly suitable for use with the further reflector or reflectors described in our co-pending British Patent Application No. 25248/72 and/or the inclined filament disclosed in our copending British Patent Application No. 25438/73.

We claim:

1. A motor vehicle lamp assembly comprising (1) a lamp reflector comprising a dished body having a reflective inner surface, said body being elliptical in vertical axial section and having a different shape in horizontal axial section, said body also having a vertical cross section in which its horizontal width is greater than its vertical height, (2) a filament mounted in said lamp reflector, and (3) a further reflector arranged to receive light from said element, said further reflector having a reflective surface lying on a paraboloid of revolution and a focal point which lies at an outer focal point of said elliptical vertical section of said reflector body.

2. The assembly according to claim 1, wherein said horizontal axial section of said body is elliptical.

3. The assembly according to claim 1, wherein said horizontal axial section of said body is arcuate.

4. The assembly according to claim 1, wherein said horizontal axial section of said body is parabolic.

5. The assembly according to claim 1, wherein said vertical axial section has an eccentricity *e* of between 0.40 and 0.75 inclusively.

6. The assembly according to claim 5, wherein said vertical axial section has an eccentricity *e* of 0.60.

7. A motor vehicle lamp assembly comprising (1) a lamp reflector comprising a dished body having a reflective inner surface, said body being elliptical in vertical axial section and having a different shape in horizontal axial section, said body also having a vertical cross section in which its horizontal width is greater than its vertical height, (2) a filament mounted in said lamp reflector, and (3) a further reflector arranged to receive light from said element, said further reflector having a reflective surface lying on a paraboloid of revolution, a mask being mounted between said lamp reflector and said further reflector at a focal point of the latter, said mask being stepped and disposed to provide a sharp, stepped cut-off for the top of a beam projected by the lamp assembly in use.

8. The assembly according to claim 7, wherein said horizontal axial section of said body is elliptical.

9. The assembly according to claim 7, wherein said horizontal axial section of said body is arcuate.

10. The assembly according to claim 7, wherein said horizontal axial section of said body is parabolic.

11. The assembly according to claim 7, wherein said vertical axial section has an eccentricity *e* of between 0.40 and 0.75 inclusively.

12. The assembly according to claim 11, wherein said vertical axial section has an eccentricity *e* of 0.60.

13. The assembly according to claim 7, wherein said lamp reflector and said stepped mask are adapted to be displaced relative to said further reflector to enable dipping of the beam projected by the headlamp assembly in use.

14. The assembly according to claim 7, wherein said mask is mounted for movement relative to said lamp reflector and said further reflector to modify a cut-off line of said beam in use.

* * * * *